US006860588B1

(12) United States Patent
Holstun et al.

(10) Patent No.: US 6,860,588 B1
(45) Date of Patent: Mar. 1, 2005

(54) INKJET NOZZLE STRUCTURE TO REDUCE DROP PLACEMENT ERROR

(75) Inventors: Clayton L Holstun, San Marcos, CA (US); Jeffrey Allen Nielsen, Corvallis, OR (US); Matthew D Giere, San Diego, CA (US); Scott Norum, La Jolla, CA (US); Stephen W Bauer, San Diego, CA (US); Mark D Lund, Vancouver, WA (US); Robert W Sperry, Austin, TX (US); Dustin W Blair, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 513 days.

(21) Appl. No.: 09/686,037

(22) Filed: Oct. 11, 2000

(51) Int. Cl.[7] ..... B41J 2/16
(52) U.S. Cl. ..... 347/47
(58) Field of Search ..... 347/171, 47, 57, 347/45, 63, 65, 92, 94, 85, 70, 20, 15, 40, 43, 12

(56) References Cited

U.S. PATENT DOCUMENTS

| | | | | |
|---|---|---|---|---|
| 3,886,565 A | | 5/1975 | Togo | 347/47 |
| 3,887,928 A | | 6/1975 | Ohno et al. | 347/55 |
| 3,928,855 A | | 12/1975 | Helinski et al. | 347/75 |
| 4,014,029 A | | 3/1977 | Lane et al. | 347/47 |
| 4,278,983 A | | 7/1981 | Halasz | 347/47 |
| 4,364,067 A | | 12/1982 | Koto et al. | 347/70 |
| 4,459,600 A | | 7/1984 | Sato et al. | 347/47 |
| 5,109,823 A | | 5/1992 | Yokoyama et al. | 123/472 |
| 5,461,406 A | | 10/1995 | Lorenze, Jr. et al. | 347/65 |
| 5,731,827 A | * | 3/1998 | Mantell et al. | 347/40 |
| 5,811,019 A | | 9/1998 | Nakayama et al. | 216/27 |
| 5,889,538 A | | 3/1999 | Kishimoto et al. | 347/43 |
| 5,929,879 A | | 7/1999 | Karita et al. | 347/40 |
| 5,956,054 A | | 9/1999 | Hirabayashi et al. | 347/37 |
| 5,992,968 A | | 11/1999 | Uetsuki et al. | 347/37 |
| 6,048,052 A | * | 4/2000 | Kitahara et al. | 347/70 |
| 6,371,596 B1 | * | 4/2002 | Maze et al. | 347/47 |

FOREIGN PATENT DOCUMENTS

| | | |
|---|---|---|
| EP | 0792744 X | 1/1997 |
| EP | 0835759 X | 10/1997 |
| EP | 1020288 X | 1/2000 |
| JP | 06023985 X | 7/1992 |

* cited by examiner

*Primary Examiner*—K. Feggins

(57) ABSTRACT

A printhead for an inkjet printer having geometric features which reduce drop placement error of main and satellite drops ejected from the nozzles of the printhead. Nozzles that are tilted along an axis corresponding to the direction of scanning of the printhead while printing have reduced drop placement error in the orthogonal direction to the scanning, and create a breakoff velocity for the satellite drop that can cause the main and satellite drops to be placed in a coincident location on the medium in one of the directions of scanning, thus forming desireable round printed spots and reducing drop placement error in the scan direction. These improvements can be repeatably achieved for all nozzles. Nozzles with non-circular and asymmetric bores also reduce drop placement errors, particularly when these types of nozzles are also tilted.

24 Claims, 11 Drawing Sheets

CIRCULAR BORE, NO NOZZLE TILT

ASYMMETRIC BORE AND/OR NOZZLE TILT

CIRCULAR BORE, NO NOZZLE TILT

ASYMMETRIC BORE AND/OR NOZZLE TILT

INKJET NOZZLE STRUCTURE TO REDUCE DROP PLACEMENT ERROR

FIELD OF THE INVENTION

The present invention generally relates to printhead structures for controllably depositing fluid onto a medium, and more particularly to novel inkjet nozzle structures formed in an orifice member for a printhead.

BACKGROUND OF THE INVENTION

Inkjet printers, and thermal inkjet printers in particular, have come into widespread use in businesses and homes because of their low cost, high print quality, and color printing capability. These printers and related hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988). The operation of such printers is relatively straightforward. In this regard, drops of a colored ink are emitted onto a print medium such as paper or transparency film during a printing operation, in response to commands electronically transmitted to a printhead. These drops of ink combine on the print medium to form the pattern of spots that make up the text and images perceived by the human eye. Inkjet printers may use a number of different ink colors. One or more printheads are mounted in a print cartridge, which may either contain the supply of ink for each printhead or be connected to an ink supply located off-cartridge for the printhead. An inkjet printer frequently can accommodate two to four such print cartridges. The cartridges are typically mounted side-by-side in a carriage which scans the cartridges back and forth within the printer in a forward and a rearward direction above the medium during printing such that the cartridges move sequentially over given locations, called pixels, arranged in a row-and-column format on the medium.

A thermal inkjet printhead typically has a substrate (preferably made of silicon or other comparable materials) with multiple thin-film heating resistors on it. Structural barriers separate the thin film resistors from each other and form a chamber into which ink flows and is heated upon selective activation of the resistors. Thermal excitation causes expulsion of the ink from the printhead through a nozzle associated with each chamber and formed on an outer nozzle member of the printhead. Initially, these nozzle members were plates manufactured from one or more metallic compositions such as gold-plated or palladium-plated nickel and similar materials. However, more recently they have been produced from organic polymers (e.g. plastics). A representative polymeric (e.g. polyimide-based) composition suitable for this purpose is a commercial product sold under the trademark "KAPTON" by E.I. du Pont de Nemours & Company of Wilmington, Del. (USA).

The set of nozzles are arranged on the printhead such that a certain width of the medium corresponding to the layout of the nozzles can be printed during each scan, forming a printed swath. The printer also has a medium advance mechanism which moves the medium relative to the printheads in a direction generally perpendicular to the movement of the carriage so that, by combining scans of the print cartridges back and forth across the medium with the advance of the medium relative to the printheads, ink can be deposited on the entire printable area of the medium. The basics of this technology are further disclosed in various articles in several editions of the *Hewlett-Packard Journal*

[Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference.

The quality of the printed output produced by the printer is a very important feature to inkjet printer purchasers, and therefore printer manufacturers pay a great deal of attention to providing a high level of print quality. In order to provide high print quality, each nozzle of the printhead should be able to repeatably deposit the desired amount of ink in precisely the proper pixel location on the medium, producing round spots or dots. However, printhead aberrations and the effects of aging can adversely affect precise ink drop placement. The actual location of misplaced drops can visibly differ from the desired location, much like missing the bulls-eye of a target. The location error can have a component in the direction in which the print cartridge is scanned; such error is known as scan axis directionality ("SAD") error. The location error can also have a component in the direction in which the print medium is advanced; such error is often called paper axis directionality ("PAD") error.

Another form of drop placement error also occurs because ink is typically not ejected from a nozzle in the form of a single drop, but rather as a main drop followed by one or more satellite drops. All of these drops would ideally be deposited in the same pixel location; however, because the main and satellite drops are ejected at slightly different times, satellite drops typically land downstream in the scan direction from the main drop. Instead of printing a round spot on the medium, non-coincident main and satellite drops can produce a non-round spot with a "tail", or even more than one spot on the medium. As the scanning speed of the printhead with respect to the medium increases, the time separation between the main and satellite drops has a greater effect, and it becomes more likely that the main and satellite drops will not result in round spots as desired.

Drop placement errors generally cause a visually significant print quality defect known as banding: strip-shaped nonuniformities that are visible throughout the printed image. Banding is particularly noticeable when the drop placement errors are not consistent from nozzle to nozzle on the printhead. Banding is also particularly noticeable when the drop placement errors for a single nozzle vary between consecutive drops, such as when the main and satellite drops sometimes coincide, but other times don't coincide. Furthermore, a combination of round and non-round spot shapes in an area on the medium which is intended to be printed with a uniform color and intensity can result in an undesireable variation of lightness and darkness within the supposedly uniform area. Accordingly, it would be highly desirable to have a new and improved inkjet printer and method for depositing drops of ink that can be utilized to repeatably produce accurately placed round spots on the print medium at all scanning speeds.

SUMMARY OF THE INVENTION

In a preferred embodiment, the present invention provides a printhead for ejecting drops of a fluid onto a medium during movement along a scanning axis that reduces PAD error and SAD error, producing accurately placed round spots on the print medium at relatively high scanning speeds so as to minimize banding, intensity variations, and other undesirable print quality defects. The printhead has chambers for controllably ejecting the drops of the ink or other fluid, with a nozzle member that is attached to the printhead and which defining a wall of the chambers. The nozzle member has a planar surface which is positionable adjacent, and preferably parallel to, a printing plane of the medium. The composition of the nozzle member is substantially uniform. Nozzles are formed in the nozzle member, with a separate nozzle in fluidic communication with each chamber. The nozzles of the preferred embodiment are tilted along the axis in which the printhead travels while emitting a swath of ink drops onto the media. In some embodiments, the interrelationship between the axis tilt and the direction of scanning result in a main drop and at least one satellite drop from an individual one of the plurality of nozzles in substantially the same location along a printing axis on the medium parallel to the scanning axis, producing a round spot. The bore of the nozzles can have a circular shape, or they can be non-circular. Non-circular bores are preferably symmetrical about the scanning axis, but may be asymmetrical about a medium advance axis orthogonal to the scanning axis. Typical non-circular bore shapes include a figure-8, a lopsided (asymmetrical about the medium advance axis) figure-8, a cashew, or a pie with a wedge removed. An alternate embodiment of a printhead uses untilted nozzles having asymmetrical non-circular bores.

In some embodiments, the nozzles of a printhead are grouped into a set of odd nozzles and a set of even nozzles. Each of the odd nozzles and each of the even nozzles may be tilted in the same direction along the scanning axis, or the odd nozzles may be tilted in the opposite direction of the even nozzles. Drops of the fluid can be ejected from the nozzles at substantially the same firing frequency during movement in both directions along the scan axis. The printhead preferentially includes a supply of a fluid fluidically coupled to the ejection chambers. The supply of the fluid may be mounted together with the printhead in a print cartridge moveable along the scanning axis, or the supply of the fluid may be positioned in a different location and fluidically coupled to the printhead.

The present invention may also be embodied as an inkjet printer having a carriage attached to a frame for relative motion with respect to the print medium in oscillating scans along a scan axis, with at least one printhead as heretofore described mounted in the carriage. The printer may include a print controller operatively coupled to the printheads for controlling the depositing of the drops of the ink on the print medium in such a manner as to reduce drop placement error and its resulting image quality defects. In one embodiment of the printer, the print controller has a one-pass unidirectional printmode which defines the interrelationship between movement of the carriage and the depositing of the drops of the ink such that the drops of the ink are deposited only when the carriage is moving in a given scan direction and not in the opposite scan direction, and the print medium is moved along the medium advance axis after each traversal of the carriage in one scan direction or the other. In another embodiment of the printer, the print controller has a one-pass bidirectional printmode which defines an interrelationship between movement of the carriage and the depositing of the drops of the ink such that the drops of the ink are deposited when the carriage is moving in both scan directions, and the print medium is moved along a medium advance axis orthogonal to the scan axis after each traversal of the carriage in the given scan direction and the opposite scan direction.

The present invention may also be implemented as a method for depositing drops of an ink on a medium with an inkjet printer. According to this method a printhead mountable in the inkjet printer and moveable along a scanning axis is provided, with the printhead having a plurality of ink ejection nozzles each having a bore axis tilted along the scanning axis. The printhead moves relative to the medium along the scanning axis and, while moving, controllably ejects a main drop from certain nozzles toward the medium in a first trajectory. In response to the ejection of the main drop, at least one satellite drop is ejected from the nozzles in a second trajectory. Both the first trajectory and the second trajectory have substantially no PAD error. In some embodiments where the axis of each nozzle bore is tilted toward a first scanning direction, the printhead will deposit both the main drop and the satellite drop from the nozzles when the printhead is moving in a second, opposite scanning direction, thus producing round dots with no SAD error.

BRIEF DESCRIPTION OF THE DRAWINGS

The above-mentioned features of the present invention and the manner of attaining them, and the invention itself, will be best understood by reference to the following detailed description of the preferred embodiment of the invention, taken in conjunction with the accompanying drawings, wherein:

FIG. 2 is a perspective view of a print cartridge according to the present invention, including the printhead, which is usable in the printer of FIG. 1 and.

DESCRIPTION OF THE PREFERRED EMBODIMENT

Figure 1:
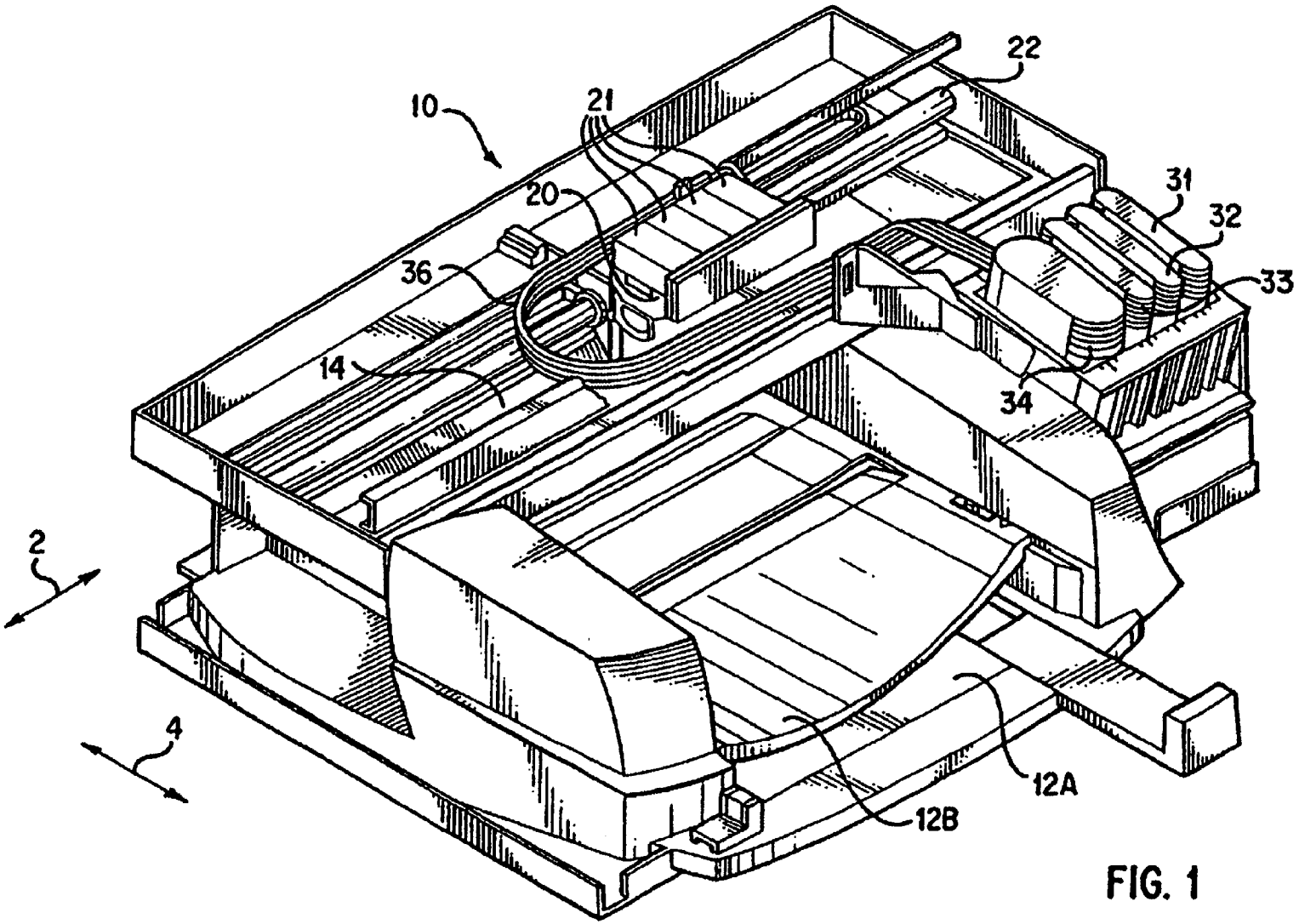
FIG. 1 is a perspective view of a printer according to the present invention which improves image quality by reducing drop placement, shape, and density errors on a printed medium.

Referring now to the drawings, there is illustrated a novel inkjet printer 10 constructed in accordance with the present invention and operated in accordance with a novel printing method which provides accurate drop placement at high scanning speeds so as to minimize visual printing defects such as banding. The printer 10 includes a novel printhead 79 having ink ejection nozzle features which reduce drop placement error in the medium advance direction 4 (known as PAD error) and in the scan axis direction 2 (known as SAD error). The minimization of objectionable banding significantly improves the quality of the printed output produced by the printer 10.

Figure 2:
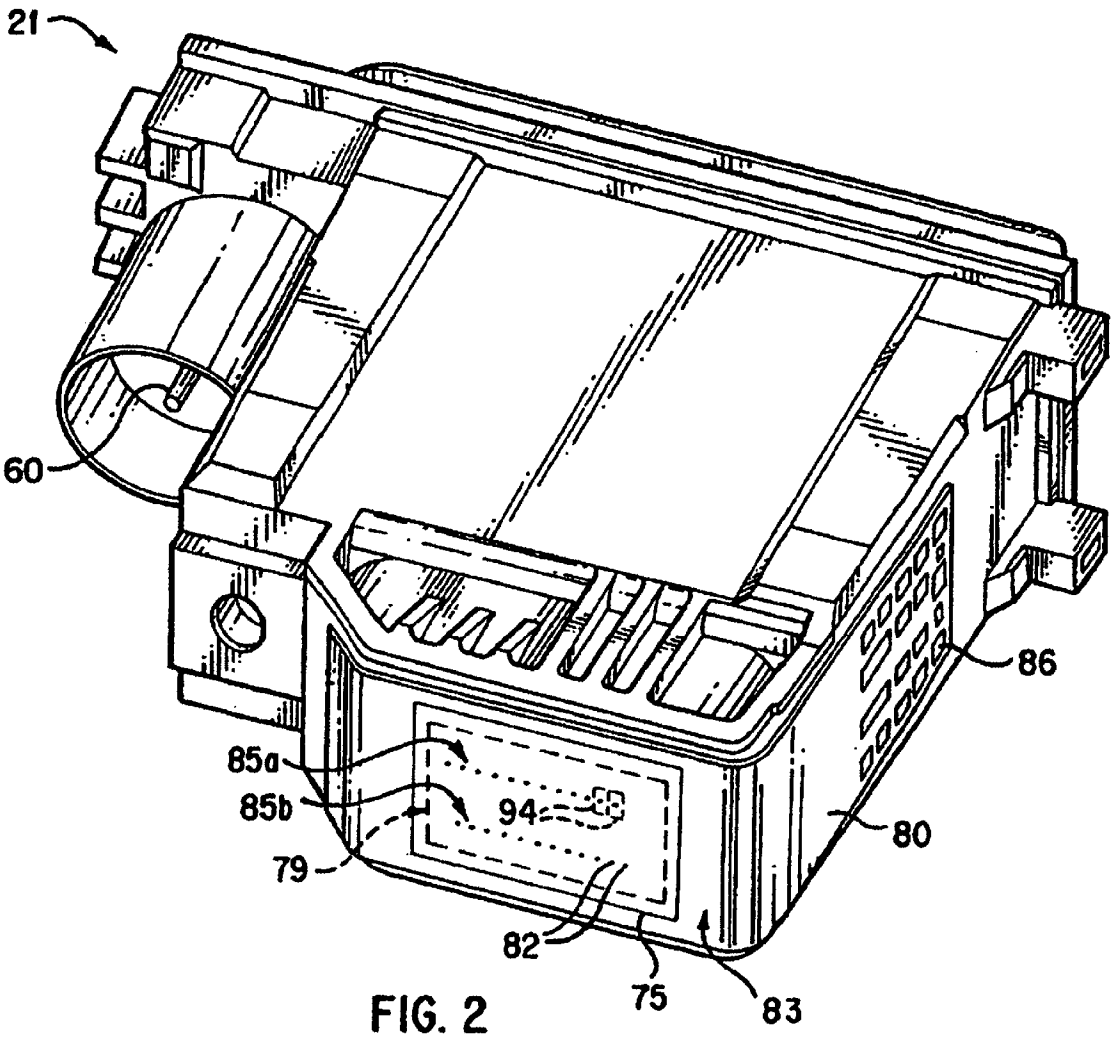

Considering now the inkjet printer 10 with reference to FIGS. 1 and 2, the printer 10 generally includes a frame 14 to which a carriage 20 is moveably mounted along a sliding rail 22. The carriage 20 has one or more stalls 23 for holding one or more corresponding print cartridges 21 and moving them relative to the surface of an adjacent print medium 18 such as paper, transparency film, or textiles. Each print cartridge 21 includes a printhead 79 having ink ejection chambers 94 for controllably ejecting the drops of the ink or other fluid used for printing. A nozzle member 75 is attached to all of the ink ejection chambers 94 and defines the wall through which the ink is ejected from the chambers 94 onto the medium 18. To allow the emission of ink from the printhead 79, nozzles 82 are formed in the nozzle member 75, an individual nozzle 82 associated with each corresponding chamber 94. As will be explained subsequently in greater detail, the nozzles 82 can be constructed with geometric features according to the present invention that reduce drop placement errors on the print medium 18.

Figure 3:
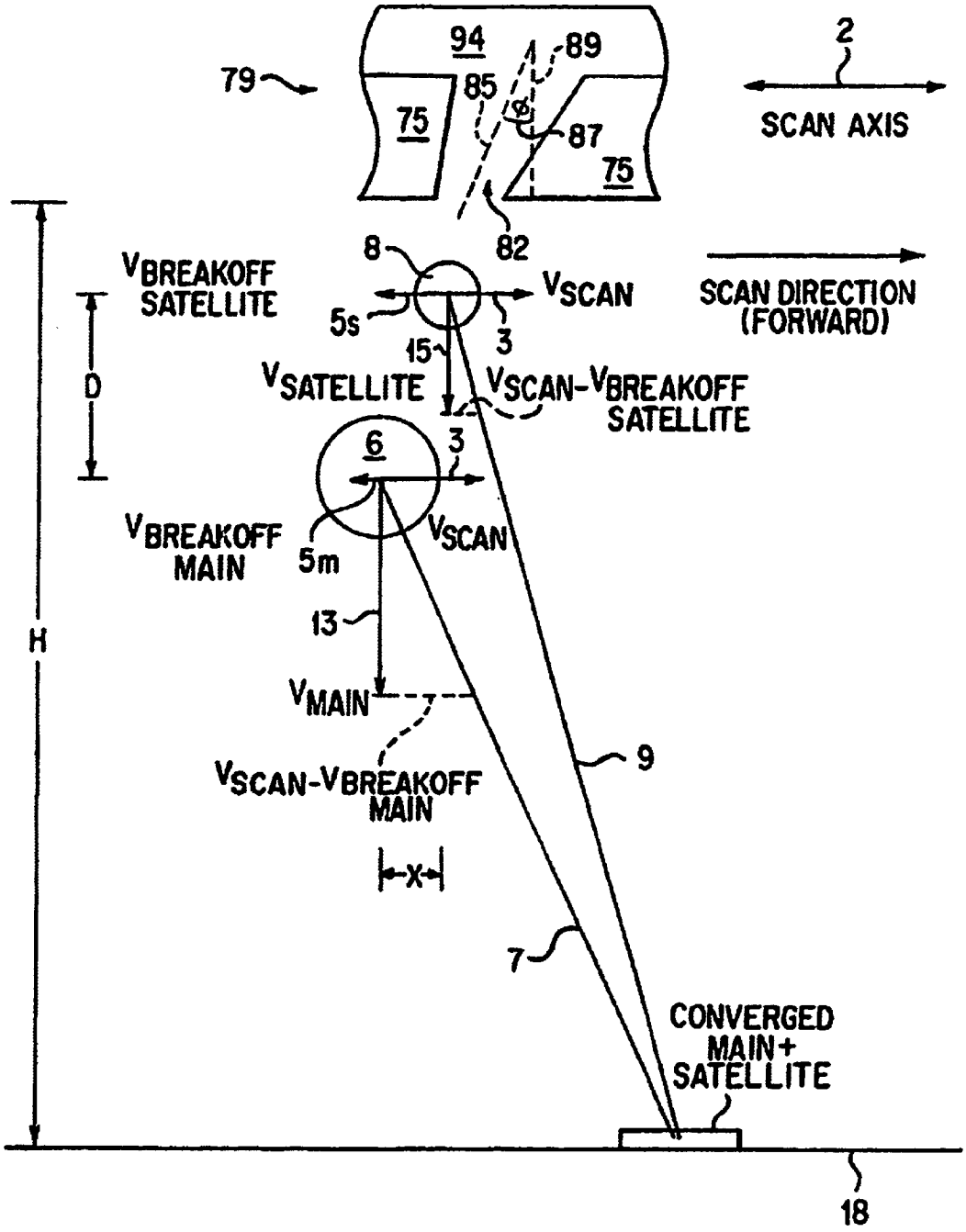
FIG. 3 is a schematic representation of the ejection of a main drop and a satellite drop from a nozzle of the print cartridge of FIG. 2 onto a print medium, illustrating the situation where the tilt of the nozzle and the carriage scanning velocity affect the trajectories of the main and satellite drops so that the drops coincide in the same location on the medium for a given height of the printhead over the medium.

In operation, and with reference to FIG. 3, a main drop 6 is controllably ejected from selected ones of the nozzles 82 toward the medium 18 with a first trajectory 7, followed by a satellite drop 8 from selected ones of the nozzles 82 toward the medium 18 in a second trajectory 9. As will be explained subsequently in greater detail, the main drop 6 and the satellite drop 8 have reduced drop placement error, including substantially no drop placement error in a medium or paper advance direction 4 (i.e. substantially no PAD error). In addition, any drop placement error in the scanning direction 2 (SAD error) that does occur becomes more consistent from nozzle to nozzle, and for repetitive ink ejections from the same nozzle 82 in the same scanning direction.

Figure 4:
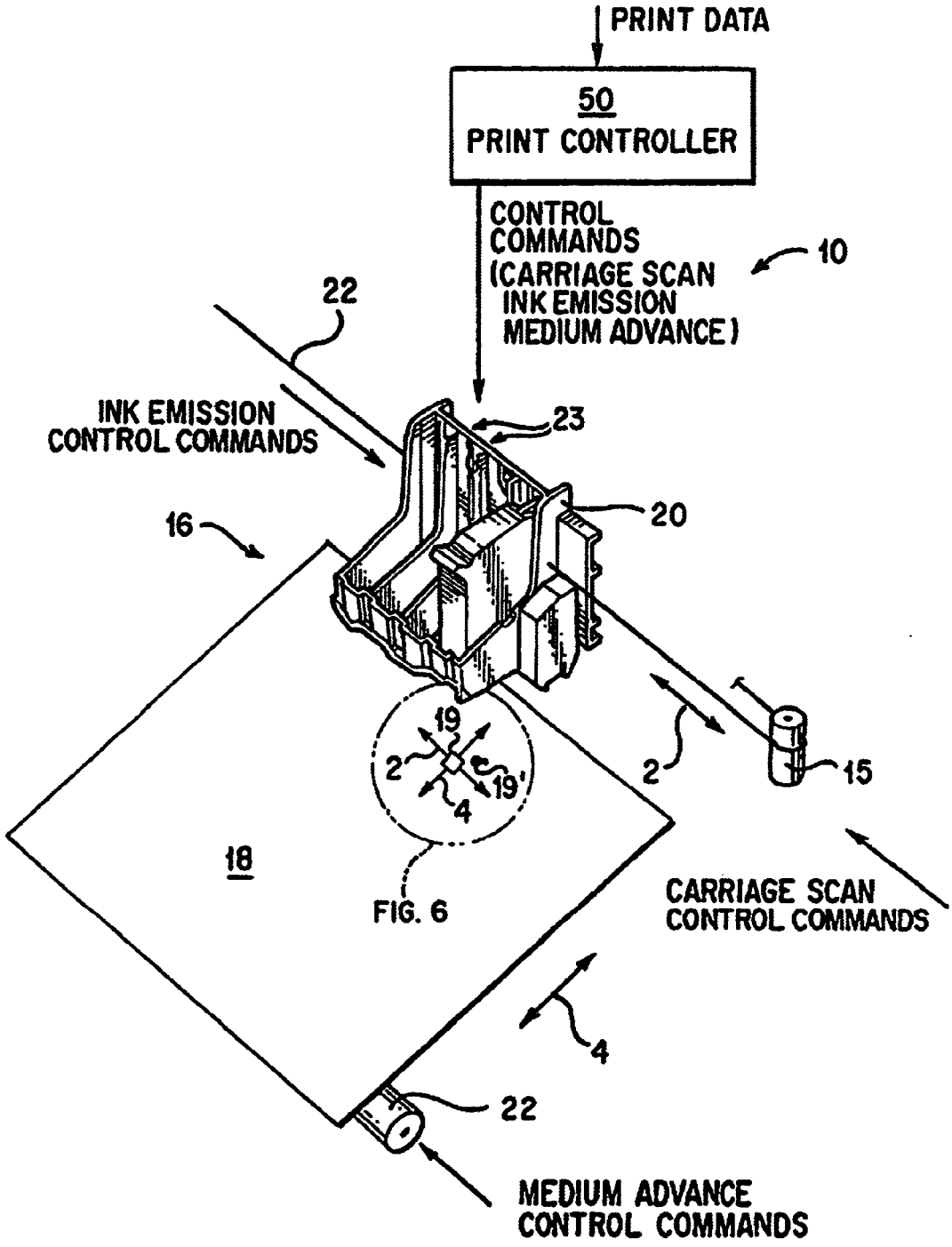
FIG. 4 is a schematic representation illustrating how the print controller of the printer of FIG. 1 locates and controls drop placement on the medium.

Considering now a preferred embodiment of the printer 10 in further detail, and as best understood with reference to FIGS. 1 and 4, the printer 10 includes an input tray 12*a* in which a supply of the media to be printed are stacked prior to printing, and an output tray 12*b* where the media are placed after printing is complete. Each medium 18 is fed into the printer and positioned adjacent the carriage 20 for printing. The print medium 18 has a plurality of pixel locations, such as pixel location 19, organized in a rectangular array of rows (along the medium advance axis 4) and columns (along the scan axis 2) on the medium 18. The print cartridge 21 is preferably installed in the carriage 20 such that the printhead 79 is facing in a downward direction and ejecting ink vertically down onto the surface of the medium 18. Ink can be supplied to the printhead 79 in a number of different ways, including from a reservoir which is self-contained in the print cartridge 21, or via a tube 36 from an off-carriage ink reservoir or vessel, such as one of reservoirs 31,32,33,34. Different print cartridges 21 (four of which are illustrated in FIG. 1) typically contain different color inks, such as magenta, yellow, cyan, and black inks, drops of which can be combined to form a variety of colored dots on the medium 18. The printer 10 also contains a print controller 50 which receives the data to be printed on the medium 18 from a data source such as a computer (not shown) which is connected to the printer 10, and determines how and when to print corresponding dots on the medium 18. The controller 50 orchestrates the printing by issuing carriage scan control commands to the scan drive mechanism 15 which moves the carriage 20 relative to the medium 18 in the scan direction 2, by issuing medium advance control commands to the medium drive mechanism 22 which moves the medium 18 relative to the carriage 20 in the medium advance direction 4, and by issuing ink emission control commands to the appropriate print cartridge 21 to eject drops of fluid from the desired nozzles 82 of the desired printhead 79 onto the medium 18. The mechanism of ink ejection will be subsequently described in greater detail.

Considering now in further detail a preferred embodiment of the print cartridge 21 according to the present invention, a flexible tape ("flex tape") 80 is adhesively mounted to the surface of the cartridge 21. The nozzle member 75 is preferably integral to the flex tape 80 with the nozzles 82 laser-ablated in the polymeric material, although alternatively the nozzle member 75 can be a metallic nozzle plate separate from the flex tape 80 and having nozzles 82 formed in the plate by any conventional process, with the flex tape 80 having a cutout in the region where the nozzle plate is located. The composition of the nozzle member 75 is substantially uniform throughout, and has a planar surface that is positioned adjacent the surface of the medium 18 during printing. Where the surface of the medium 18 is positioned in the printer 10 so as to form a printing plane, the planar surface of the nozzle member 75 is preferably positioned coplanar with the printing plane. The electrical signals for the ink emission control commands are communicated to the cartridge 21 through a set of interconnection pads 86 on the front surface of the flex tape 80. When the cartridge 21 is seated in the stall 23, a set of mating contacts (not shown) in the stall 23 and connected to the print controller 50 transmit the electrical signals from the print controller 50 to the interconnection pads 86. On the print cartridge 21, the pads 86 are electrically connected to the printhead 79 via traces contained in a flex tape 80 which mate with the printhead 79 when it is mounted to the back surface of the flex tape 80. In this way the electrical signals necessary to activate the thin-film resistors 70 are transmitted front the print controller 50 to the ink ejection chambers 94. In the case of an off-carriage ink supply, ink is supplied through the tube 36 to an ink input port 60 of the print cartridge 21, and then internally to the ink ejection chambers 94, as will be discussed subsequently in further detail. The nozzles 82 are preferentially organized into two parallel columns of equally-spaced nozzles, with a column 85*a* containing a quantity of odd-numbered nozzles 82 and a column 85*b* containing the same quantity of even-numbered nozzles 82. The nozzle columns 85*a,b* are offset from each other in the medium advance direction 4 by a distance equal to one-half of the spacing between two nozzles in a column, such that the two columns 85*a,b* can be logically treated by the print controller 50 as a single column of twice as many nozzles and having twice the number of nozzles per inch in the medium advance direction 4 of either column 85*a,b* individually. Analyzed from the perspective of the printed medium 18, rows of drops printed by odd nozzles alternate with rows of drops printed by even nozzles. As it is scanned along the scan axis 2 with respect to the medium 18, the printhead 79 produces a printed swath having a height in the medium advance direction 4 corresponding to the number and spacing of the columns 85*a*,85*b* of nozzles 82. The medium 18 is periodically advanced in the medium advance direction 4 by an distance equivalent to part or all of the swath height, depending on the particular printmode used by the printer 10 to fully print a swath.

Figure 5:
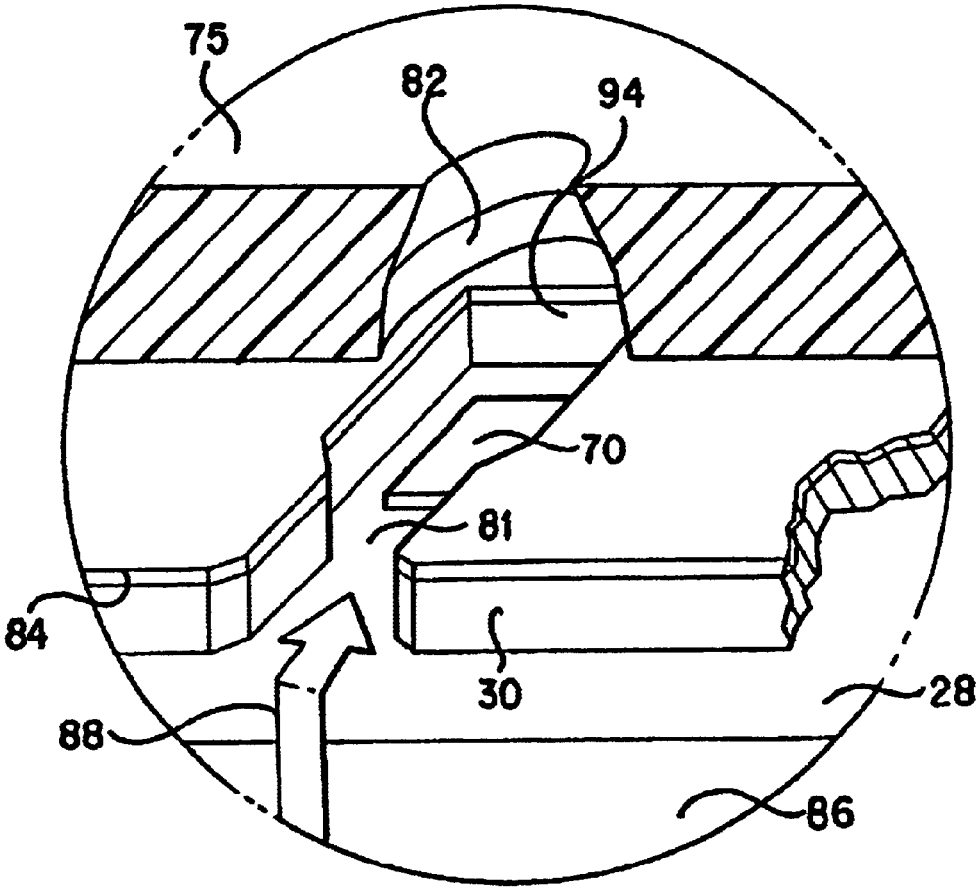
FIG. 5 is a cross-sectional view of a single ink ejection chamber and nozzle of the printhead in the print cartridge of FIG. 2.

Considering now in further detail a single ink ejection chamber 94 and associated nozzle 82 of a preferred embodiment of the printhead 79, and with reference to FIG. 5, the chamber 94 has a thin film resistor 70 formed on a substrate 28. A side edge of the substrate 28 is shown as edge 86. A barrier layer 30 is deposited on the substrate 28 so as to form the chamber 94. The nozzle member 75 is attached to the barrier layer 30 by a thin adhesive layer 84. In operation, ink flows around the side edge 86 of the substrate 28, and into the ink channel 81 and associated ink ejection chamber 94, as shown by the arrow 88. Upon energization of the thin film resistor 70 by electrical signals as orchestrated by the print controller 50, a thin layer of the adjacent ink is superheated, causing explosive vaporization and, consequently, causing a main drop and one or more satellite drops of ink to be ejected through the nozzle 82. The ink ejection chamber 94 is then refilled by capillary action. The time required to heat the ink, vaporize and eject main and satellite drops, and refill the chamber 94 defines a maximum firing frequency at which ink can be ejected from the chamber 94 onto the medium 18. In the preferred embodiment, ink is ejected from the chamber 94 at the same firing frequency regardless of in which direction along the scan axis 2 the print cartridge 21 is being moved; there is no need to print more slowly in one direction than in another.

Figure 6:
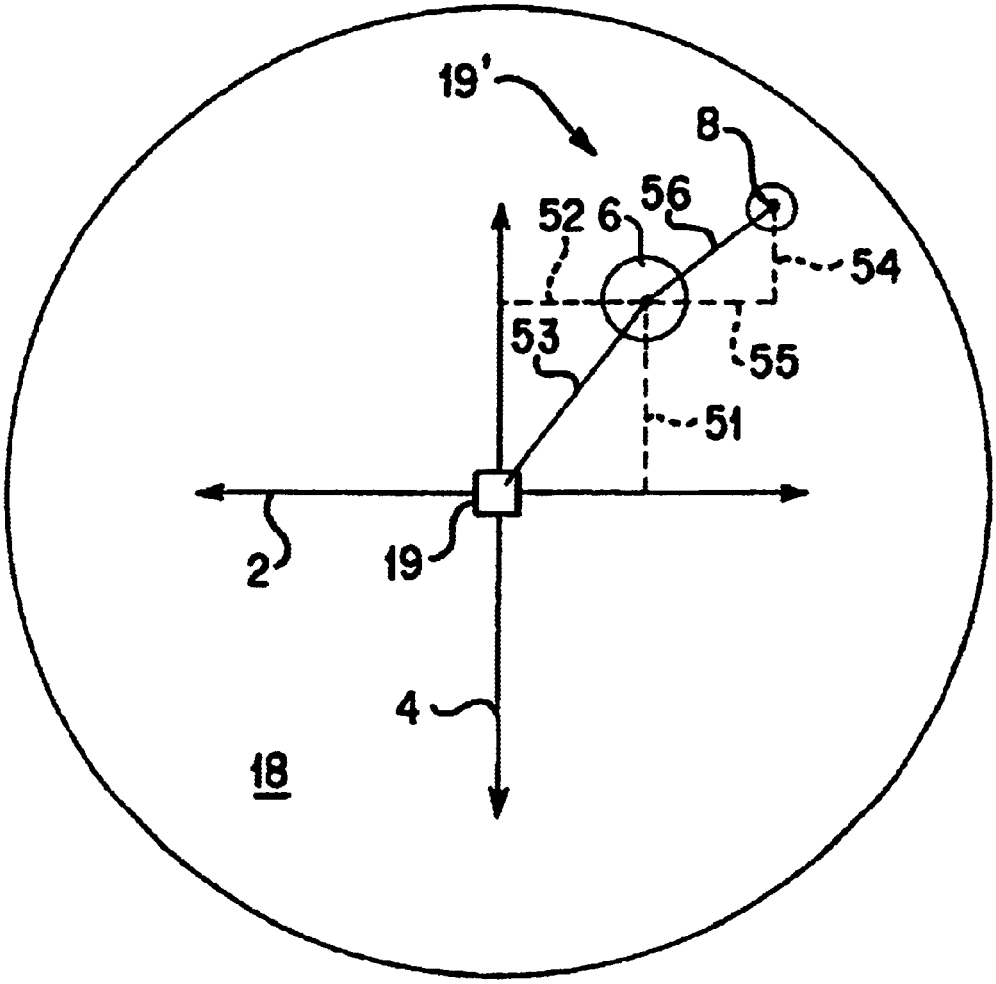
FIG. 6 is a schematic representation of drop placement and shape errors with respect to the scan axis and medium advance axis.

Considering now with reference to FIGS. 3, 4, and 6 the drop placement error (also known as directionality error or concentricity error) associated with the main and satellite drops ejected from the ink ejection chamber 94 is defined as the distance between the printed drop location 19', and the intended pixel location 19. The drop placement error can have a scan axis directionality ("SAD") component in the direction along the scan axis 2, and a paper axis directionality ("PAD") component in the direction along the medium advance axis 4. Where the main 6 and satellite 8 drops are not coincident on the medium 18 (as in FIG. 6), the drop placement error may be determined with respect to a centroidal position of the two drops 6,8. Alternatively, the drop placement error of the drops 6,8 may be measured with respect to the drops 6,8 individually, with the main drop 6 having a drop placement error 53 with a PAD component 51 and a SAD component 52 relative to the intended location 19, and the satellite drop 8 having a drop placement error 56 with a PAD component 54 and a SAD component 55 with respect to the main drop 6.

In many printheads 79, the drop placement error of the main drop 6 tends to be relatively consistent, and some types of errors can often be compensated for by the print controller 50 so as to more closely align the main drop 6 to the desired location 19. However, in prior printheads the drop placement error of the satellite drop 8 tends to have variable amounts of SAD and PAD error, (and thus a variable aggregate direction vector) from chamber 94 to chamber 94, and from drop to drop from the same chamber 94. This variable drop placement error cannot be compensated for by the print controller 50, and becomes worse at higher scanning speeds. While the directionality of the main drop 6 is less affected by the angling and the shape of the nozzle 82, these nozzle features have a more significant effect on the directionality of the satellite drop 8. By carefully controlling these characteristics, the present invention reduces the drop placement error of the satellite drop 8 so as to minimize adverse effects on print quality.

Figure 7:
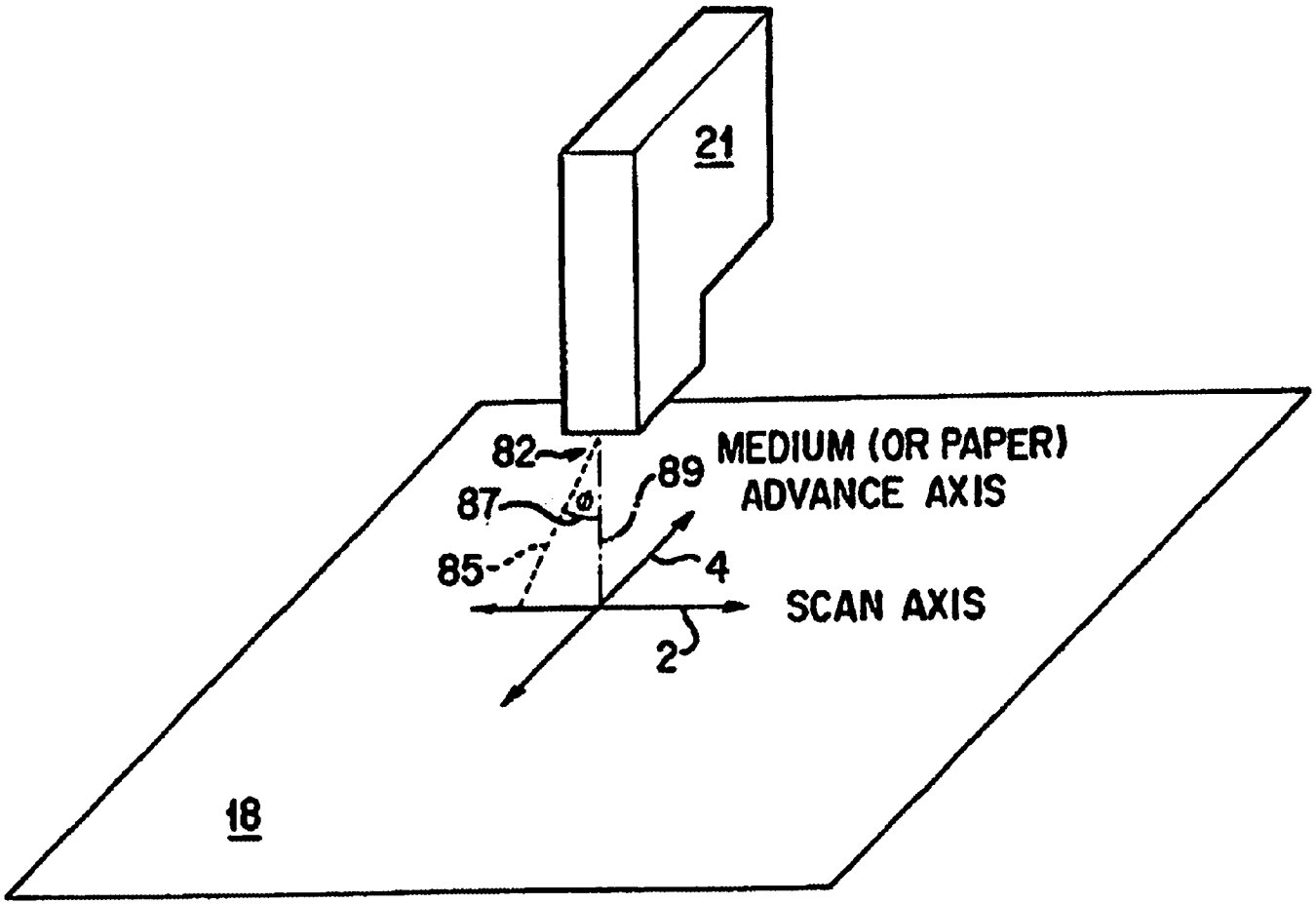
FIG. 7 is a schematic representation of tilting the bore of a nozzle along the scan axis of FIG. 6 to reduce drop placement error.
Figure 8A:
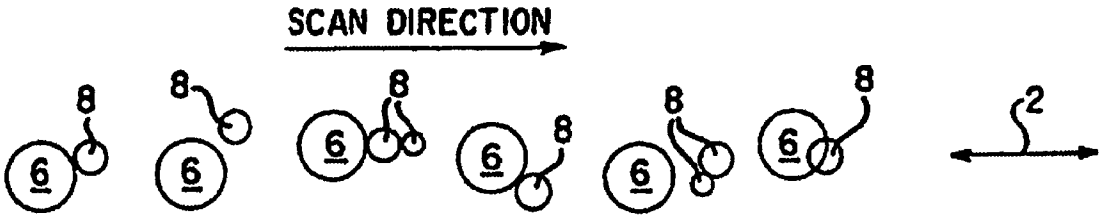
FIG. 8A is a schematic illustration of satellite drops having PAD and SAD error.

Considering in further detail, with reference to FIGS. 7 and 8A, the effect on the satellite drop 8 of angling or tilting the typically circular bore of the nozzle 82 with respect to the vertical 89, a print cartridge 21 installed in the printer 10 in an orientation such that the axes 85 of the nozzle bores (referred to herein as bore axes 85 or nozzle axes 85) are substantially vertical tends to have a highly variable directionality error. This effect is at least partially due to the difficulty in ensuring that the bore axes 85 in the nozzles 82 of installed print cartridges 21 are absolutely vertical; in most cases, the axes 85 will have a small amount of tilt, with the tilt occurring in different directions due to minor manufacturing variations in the fabrication of the nozzles and the installation of the cartridge 21 in the printer 10. As illustrated in FIG. 8A, a substantially vertical nozzle 82 typically produces satellite drops 8 having both PAD and SAD error which varies from nozzle firing to nozzle firing. However, by fabricating the nozzles 82 with a bore axis tilt in a given direction in excess of the amount of tilt from manufacturing variations, the direction and magnitude of the drop placement error can be more precisely controlled. In this situation, the effects of the intentional tilt will dominate the effects of the manufacturing and installation variations, allowing improved drop placement performance. The intentional tilt typically has a tilt angle Ø 87 in the range of 0.2 to 1.4 degrees, and more preferably in the range of 0.4 to 0.9 degrees. Utilizing such a tilt angle Ø 87 for the intentional tilt will make the drop placement performance less sensitive to fabrication and installation variations. Since PAD error is typically more perceptible to the human eye than SAD error, the intentional tilt is preferably induced in a direction that will minimize PAD error. PAD error can be minimized according to the present invention by orienting the intentional tilt from vertical 89 in the bore axes 85 to be along the scan axis 2. The same amount and direction of intentional tilt is preferably induced in both the odd nozzles 85*a* and the even nozzles 85*b*. The direction of the intentional tilt (e.g. in the forward scanning direction or the reverse scanning direction) along the scan axis 2 does not significantly affect the PAD error reduction.

Figure 8B:
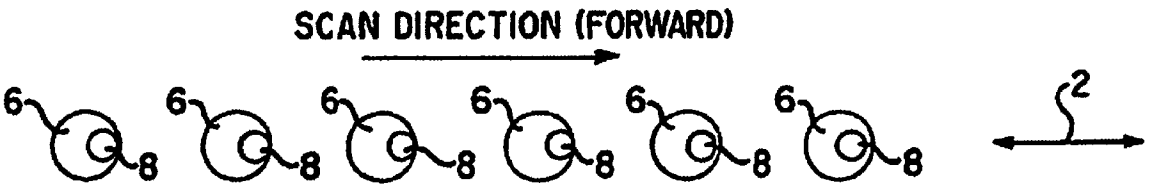
FIG. 8B is a schematic illustration of a nozzle producing satellite drops which exhibit minimal PAD and SAD error in a given scanning direction.
Figure 8C:
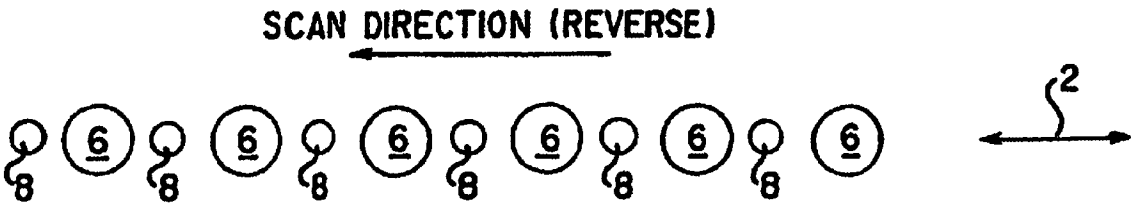
FIG. 8C is a schematic illustration of a nozzle producing satellite drops which exhibit minimal PAD error but substantial SAD in a scan direction opposite to the scan direction of FIG. 8B.

Considering now the effect on SAD error that occurs when an intentional tilt in the direction of the scan axis 2 is introduced in the bore axis 85 to minimize PAD error, and with reference to FIGS. 3 and 8B–C, several factors determine the main drop trajectory 7 and the satellite drop trajectory 9 which result in the drop placement location of the main drop 6 and satellite drop 8 on the medium 18. The satellite drop 8 has a lower expulsion velocity ($V_{satellite}$, typically about six to eight meters per second) 15 than the expulsion velocity ($V_{main}$, typically about twelve meters per second) 13 of a main drop 6. The difference in expulsion velocities and ejection times, combined with the moving print cartridge 21, tends to cause the satellite drop 8 to land away from the main drop 6 in the downstream direction of scanning. In addition, during ejection the satellite drop 8 also acquires a breakoff velocity $V_{breakoff\ satellite}$ 5*s* in the direction of nozzle tilt. This velocity component is present to a lesser degree in the main drop 6, which acquires a breakoff velocity $V_{breakoff\ main}$ 5*m*. When the print cartridge 21 is scanned in the same direction as the bore axis 85 is tilted (e.g. scanning in the reverse scanning direction when the tilt is also in the reverse scanning direction), the scanning velocity ($V_{scan}$) 3 adds to the breakoff velocities 5*s,m*. The difference in magnitudes of the breakoff velocities 5*s,m*, combined with the difference in expulsion velocities 13,15, causes the satellite drop 8 to move away from the main drop 6, with the printed result as illustrated in FIG. 8C. Conversely, when scanning in the direction opposite to the tilt (e.g. scanning in the forward scanning direction when the tilt is in the reverse scanning direction, as illustrated in FIG. 3), the scanning velocity ($V_{scan}$) 3 subtracts from the breakoff velocities 5*s,m* to cause the satellite drop 8 to move back towards the main drop 6 during flight, as illustrated in FIG. 8B. For given expulsion velocities, the optimal amount of nozzle tilt is determined from the scanning velocity ($V_{scan}$) 3, the vertical height (H) of the printhead 79 above the medium 18, and the time delay between ejection of the main drop 6 and the satellite drop 8, with the amount of tilt selected so as to have the satellite drop 8 coincide on the medium 18 with the main drop 6 while the print cartridge 21 is scanning in the direction opposite to the tilt, as illustrated in FIG. 3. For a scanning velocity of approximately 0.75 meters per second, a vertical height of about 1250 micrometers, and an ejection delay of about 10 microseconds, a nozzle tilt of 0.2 to 1.4 degrees in the scanning direction will consistently cause the placement on the medium 18 of the main drop 6 and satellite drop 8 to coincide.

Figure 9A:
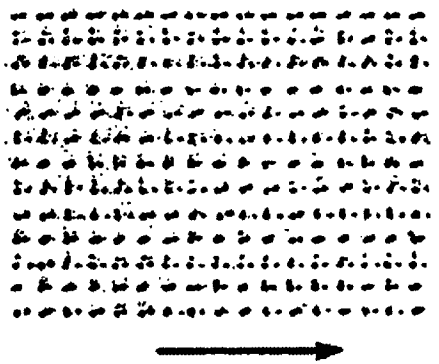
FIGS. 9A–B are schematic illustrations of printed output from circular nozzles having no tilt and exhibiting significant PAD and SAD error.
Figure 9C:
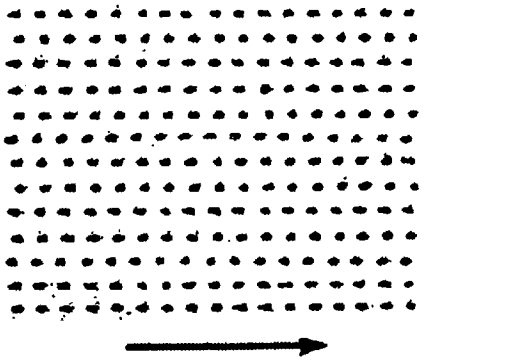
FIG. 9C is a schematic illustrations of printed output from nozzles having circular bores tilted along the scan axis in a direction opposite to the scanning direction as in FIG. 7, or from asymmetric non-circular bores (with or without such tilt) in which the breakoff velocity vector is along the scan axis in the direction opposite to the scanning direction, the printed output exhibiting reduced PAD and SAD error.
Figure 9B:
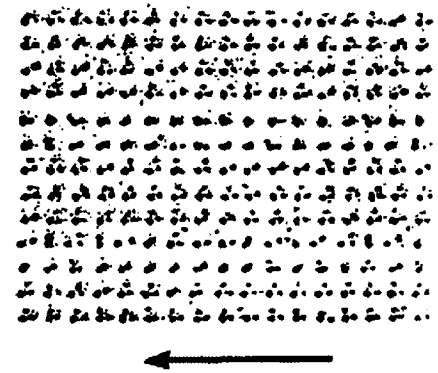
Figure 9D:
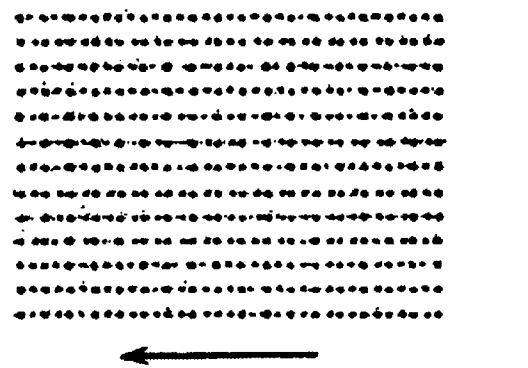
FIG. 9D is a schematic illustrations of printed output from nozzles having circular bores tilted along the scan axis in the same direction as the direction of scanning, or from asymmetric non-circular bores (with or without such tilt) in which the breakoff velocity vector is along the scan axis in the same direction as the scanning direction, the printed output exhibiting reduced PAD error but significant SAD error.
Figure 10B:
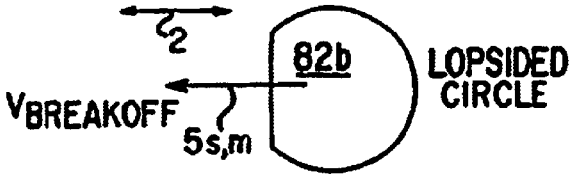
FIGS. 10A–G are illustrations, viewed at the nozzle member, of the nozzle bore shape and breakoff velocity vectors associated with different nozzle bore geometries usable with the printhead of the print cartridge of FIG. 2.
Figure 10C:
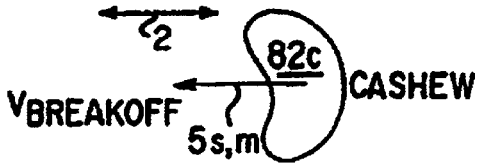
Figure 10D:
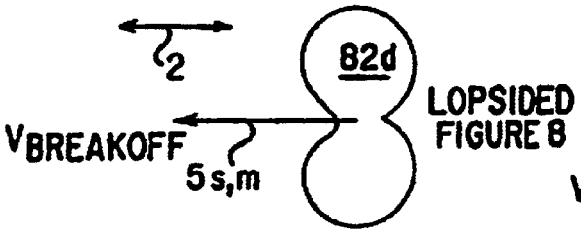
Figure 10E:
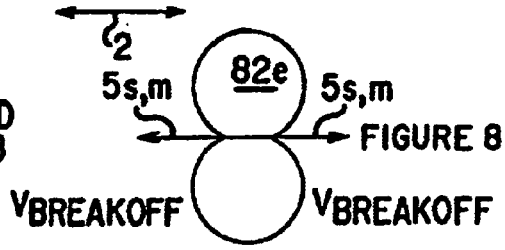
Figure 10F:
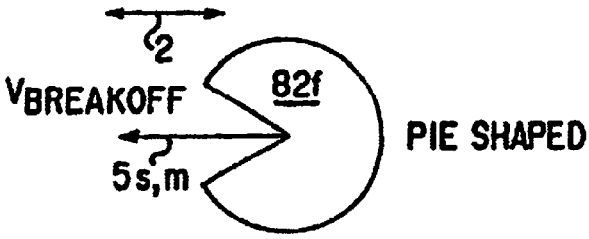
Figure 10G:
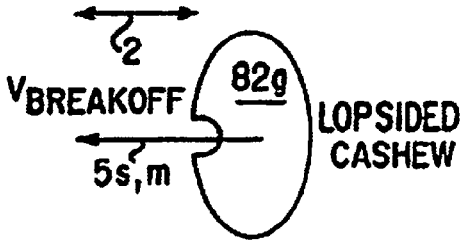
Figure 10A:
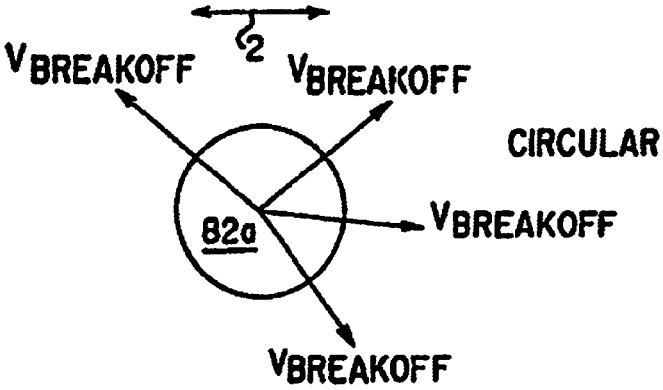

FIGS. 9A–D illustrate the drop placement error for a set of nozzles 82. FIGS. 9A–B illustrate magnified ink depositions on the medium 18 printed in the forward and reverse scanning directions from a printhead 79 with circular nozzles 82 having untilted (i.e. substantially vertical) bores respectively. It is observed that the occurrence and drop placement error of satellite drops differs from nozzle to nozzle, and for different firings of the same nozzle, regardless of the scanning direction, causing objectionable horizontal banding. By comparison, the main 6 and satellite 8 drops of FIG. 9C, which illustrates output printed in the forward scanning direction from a printhead 79 having nozzles 82 tilted in the reverse scanning direction, consistently coincide in the same location such that the satellites 8 are not visible. In FIG. 9D, which illustrates output printed in the reverse scanning direction from the same printhead 79 of FIG. 9C, satellite drops are consistently visible, but since there is no perceivable PAD error, there is no horizontal banding. In order for the nozzles 82 to operate as illustrated in FIGS. 9C–D and heretofore described, it may be required to eject several drops from the nozzles to initialize the proper behavior. These start-up emissions can either be printed on a very small portion of the medium 18 or in an ink spittoon or service station (not shown) in the printer 10.

In a preferred embodiment, the odd column 85*a* and the even column 85*b* of nozzles 82 on the printhead 79 are both tilted in the same direction. Such a configuration will generate coincident main 6 and satellite 8 drops from all nozzles in one scanning direction, and separated main 6 and satellite 8 drops from all nozzles in the other scanning direction. As a result, the entire swath printed by the printhead 79 in one scanning direction produces output as in FIG. 9C, and output as in FIG. 9D in the other scanning direction. Such a nozzle configuration is particularly beneficial in providing high image quality, particularly for the edges of text, when used in combination with a one-pass unidirectional printmode that deposits drops only when scanning in the direction in which the main drops 6 and the satellite drops 8 coincide. In addition to the main and satellite drops forming substantially round spots on the medium 18, the spot size and spot density (equivalent to perceived lightness or darkness of the spot) are also uniform for all spots, and adjacent drops can coalesce to form uniform areas during drying.

In an alternate embodiment, the odd column 85*a* and the even column 85*b* of nozzles 82 on the printhead 79 are each tilted in opposite directions. Since odd and even nozzles form alternate rows on the medium 18, such a configuration will generate printed output where, for a given scanning direction, the spots in one printed row have coincident main and satellite drops, while the spots in the adjacent printed row have distinct main and satellite drops. Such a nozzle configuration is useful in printmodes utilizing any number of passes, but is particularly beneficial when used in combination with a one-pass bidirectional printmode, where alternate swaths are printed in opposite scanning directions. Since each swath of a one-pass bidirectional printmode contains both coincident and non-coincident main 6 and satellite 8 drops, this nozzle arrangement where the columns 85*a,b* are tilted in opposite directions provides a balanced design in which the perceived image quality of alternate swaths is closely matched.

An alternate embodiment of the present invention, as best understood with reference to FIGS. 10A–G, utilizes non-circular nozzle bores through the nozzle member 75, instead of circular bores. Such a nozzle design provides beneficial drop placement effects similar to those obtainable, as has been heretofore described, by tilting the nozzles 82. While the breakoff velocity ($V_{breakoff}$) vector 5*s,m* of the satellite drop 8 can occur in any of a large number of different directions for different firings of a circular bore 82*a*, the geometric features of asymmetric non-circular bores cause the breakoff velocity vector 5*s,m* to consistently occur in a single direction. Asymmetric non-circular bores are symmetrical about the scan axis 2, but not about the medium advance axis 4, and include, but are not limited to, bores having the shape of a lopsided circle 82*b*, cashew 82*c*, lopsided figure-8 (or lopsided kidney) 82*d*, pie-shape 82*f*, and lopsided cashew 82*g*. Symmetric non-circular bores can have a small number of possible breakoff velocity vectors 5*s,m*; for instance, a bore 82*e* having the shape of a figure-8 (or kidney) has two possible vectors located at either side of the waist of the figure-8. To minimize PAD error, non-circular bores 82*b–g* must be rotated so as to align the (or one of the) breakoff vectors with the scanning axis. In addition, in order to establish a consistent and repeatable breakoff vector 5*s,m* so as to ensure that all nozzles have a consistent SAD for all firings in a scan direction, a symmetric non-circular bore must also be tilted along the scanning axis as described heretofore for a circular bore. As a practical matter, since tilt has a stronger effect on directionality than does non-circularity of the nozzle bore, tilting even asymmetric non-circular bores is preferable unless absolute vertical alignment of the bores when the cartridge 21 is installed in the printer 10 can otherwise be assured. The nozzle bores preferably widen, or taper away, from the surface of the nozzle member 75 at which the drops are ejected and toward the interior of the nozzle member 75. The tapering is preferably constant at a taper angle of about eight to nine degrees, such that the bores retain the same cross-sectional shape throughout the nozzle member 75.

Figure 11:
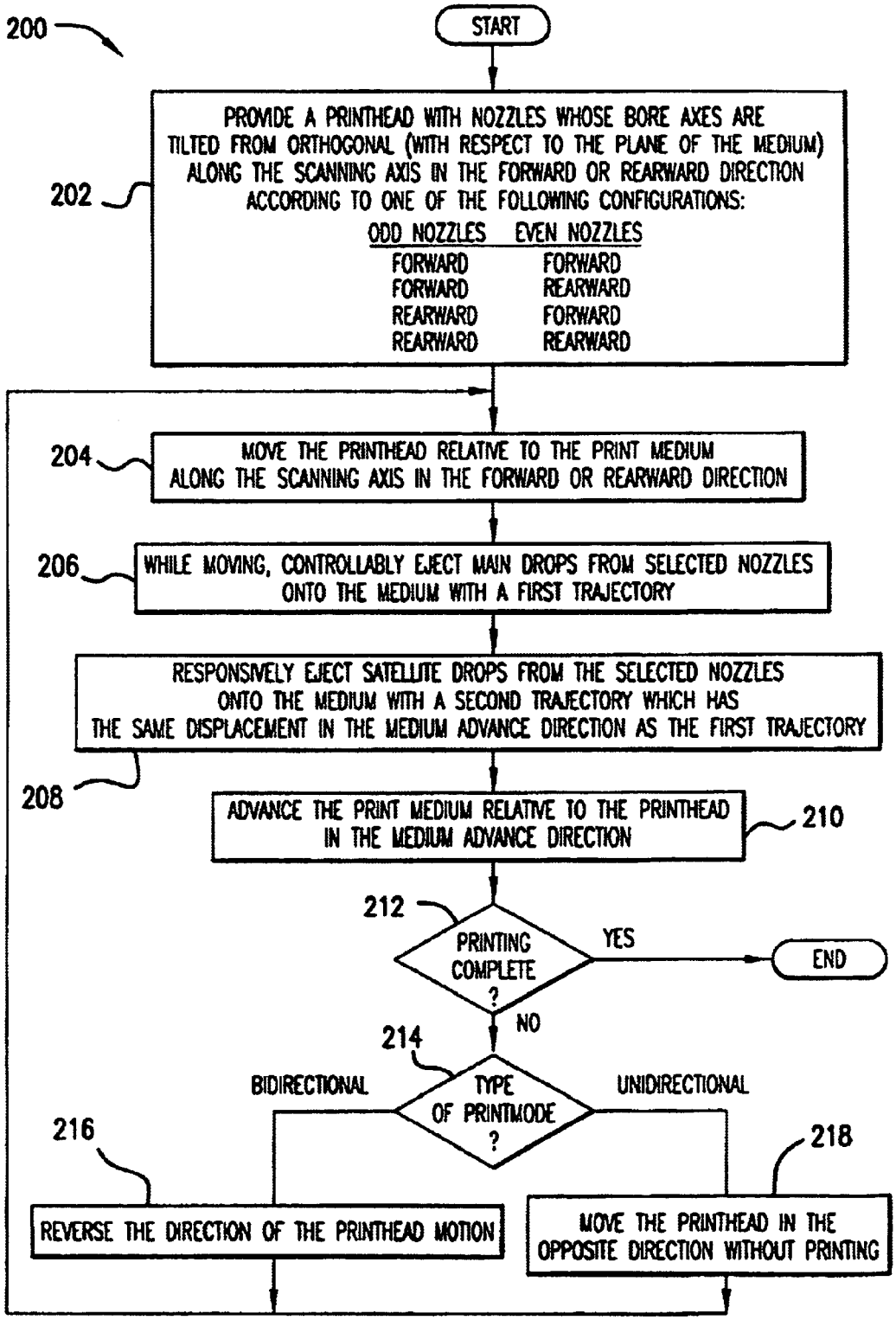
FIG. 11 is a flowchart of a method for depositing drops of an ink on a medium with the inkjet printer of FIG. 1.

The present invention can also be implemented, with reference to FIG. 11, as a method 200 for depositing drops of an ink on a medium 18 with an inkjet printer 10. At 202, a printhead 79 with nozzles 82 whose bore axes are tilted from orthogonal (with respect to the plane of the medium 18) along the scanning axis 2 in the forward or rearward direction is provided. The odd nozzles and the even nozzles can be tilted in the same direction or different directions, forward or rearward. At 204, the printhead 79 is moved relative to the print medium 18 along the scanning axis 2 in the forward or rearward direction. Typically this printhead 79 movement begins at one side of the printer 10, or at a location corresponding to the position on the medium 18 to be printed nearest that side of the printer 10, and proceeds along the scanning axis 2 to the other side of the printer 10 or to a position corresponding to the farthest position on the medium 18 to be printed in the current swath. At 206, the printhead 79, while moving, controllably ejects main drops 6 from selected nozzles 82 onto the medium 18 with a first trajectory 7, as described heretofore. At 208, and also as described heretofore, the printhead 79 also responsively ejects one or more satellite drops 8 from the selected nozzles 82 with a second trajectory 9 which has substantially the same displacement in the medium advance direction 4 as the first trajectory 7, so as to minimize PAD error. In addition, if the tilt of the nozzles 82 is in a direction along the scan axis 2 opposite to the current direction (forward or rearward) of movement, then (depending on the breakoff velocities 5*s,m* and other factors, and as previously described) the main drop 6 and the satellite drop 8 may coincide on the medium 18. At 210, when the current traversal of the printhead 79 along the scan axis 2 is complete, the print medium 18 may be advanced relative to the printhead 79 in the medium advance direction 4. However, in some multi-pass printmodes, this advance may not occur after each traversal. At 212, and if printing is complete, the method ends. If printing is not complete, the next action to be taken depends on whether the printmode is unidirectional or bidirectional as performed at 214. If bidirectional, the direction of printhead motion is reversed at 216, and the method continues at 204 with traversal occurring in the opposite direction as on the previous pass. In the preferred embodiment, the scanning speed is the same in both directions so as to maximize throughput. If unidirectional, the printhead is moved in the opposite direction without printing at 218, and the method continues at 204 with traversal occurring in the same direction as for the previous pass.

From the foregoing it will be appreciated that the novel inkjet printer having printhead nozzles with tilted or non-circular bores and method for reducing drop placement errors as provided by the present invention represent a significant advance in the art. Although several specific embodiments of the invention have been described and illustrated, the invention is not limited to the specific methods, forms, or arrangements of parts so described and illustrated. In particular, the claimed invention and its novel developments are applicable to all types of printing systems without limitation provided that they include (1) at least one substrate as discussed herein; (2) at least one ejection chamber positioned on the substrate which, when activated, causes fluidic material to be expelled on-demand from the printhead; and (3) an orifice plate having one or more nozzles ink therethrough that is positioned above the substrate having the ejection chamber(s) thereon. The claimed invention shall not be considered "ejector-specific" and is not limited to any particular applications, uses, and fluid compositions. It is important to note that the present invention is especially suitable for use with fluid delivery systems that employ thermal inkjet technology. Accordingly, the novel orifice plate structures discussed herein have been described in connection with thermal inkjet technology with the understanding that the invention shall not be limited to this type of system. The claimed technology is instead prospectively applicable to a wide variety of different printing devices provided that they again employ the basic structures recited herein which include a substrate, at least one ejection chamber on the substrate, and an orifice plate positioned above the substrate/ ejection chamber(s) having nozzle(s) therein. In addition, while ink is the preferred embodiment of a fluid to be printed on the medium, the present invention is not limited to the ejection and depositing of ink. Other fluids capable of vaporization upon the application of temperature can be used with the novel features disclosed herein. The invention is limited only by the claims.

What is claimed is:

1. A printhead for ejecting drops of a fluid onto a medium during movement along a scanning axis, comprising:

a plurality of chambers for controllably ejecting the drops;

a nozzle member attached to the printhead and defining a wall of each of the chambers, the nozzle member having a planar surface positionable adjacent the medium; and a plurality of nozzles formed in the nozzle member and in fluidic communication with each chamber, wherein certain ones of the nozzles have a nozzle axis tilted along the scanning axis.

2. The printhead of claim 1, wherein the nozzle axis is tilted so as to deposit during a single fluid deposition operation a main drop and at least one satellite drop from an individual one of the plurality of nozzles in substantially the same location on the medium.

3. The printhead of claim 1, wherein the nozzle axis is tilted so as to deposit during consecutive fluid deposition operations drops from an individual one of the plurality of nozzles substantially along a printing axis parallel to the scanning axis.

4. The printhead of claim 1, wherein the planar surface is positioned generally parallel to a surface of the medium being printed.

5. The printhead of claim 1, wherein the planar surface is coplanar with a printing plane of the medium.

6. The printhead of claim 1, wherein the certain ones of the nozzles have a non-circular bore through the nozzle member.

7. The printhead of claim 6, wherein the bore has the shape of a FIG. 8.

8. The printhead of claim 6, wherein the nozzle axis is tilted between 0.4 degrees and 0.9 degrees from vertical.

9. The printhead of claim 6, wherein the non-circular bore is symmetrical about the scanning axis but asymmetrical about a medium advance axis orthogonal to the scanning axis.

10. THe printhead of claim 8, wherein the bore has the shape of a cashew.

11. The printhead of claim 8, wherein the bore has the shape of a lopsided FIG. 8.

12. The printhead of claim 8, wherein the bore has the shape of a pie with a wedge removed.

13. The printhead of claim 1, wherein the nozzle axis is tilted between 0.2 degrees and 1.4 degrees from vertical.

14. The printhead of claim 1, wherein the plurality of nozzles are grouped into a set of odd nozzles and a set of even nozzles, and wherein the nozzle axes of each of the odd nozzles and each of the even nozzles are tilted in the same direction along the scanning axis.

15. The printhead of claim 1, wherein the plurality of nozzles are grouped into a set of odd nozzles and a set of even nozzles, and wherein the nozzle axes of each of the set of odd nozzles is tilted in one direction along the scanning axis and the nozzle axes of each of the set of even nozzles is tilted in an opposite direction along the scanning axis.

16. The printhead of claim 1, wherein the drops of the fluid are ejected at substantially the same firing frequency during movement in both a forward and a rearward direction along the scan axis.

17. The printhead of claim 1, wherein the composition of the nozzle member is substantially uniform.

18. The printhead of claim 1, further including:

a supply of a fluid fluidically coupled to the plurality of chambers.

19. The printhead of claim 15, wherein both the supply of the fluid and the printhead are mounted in a print cartridge moveable along the scanning axis.

20. The printhead of claim 15, wherein the printhead is mounted in a print cartridge moveable along the scanning axis and fluidically coupled to the supply of the fluid positioned in a different location.

21. The printhead of claim 1, wherein the certain ones of the nozzles are all of the plurality of nozzles that are configured to eject the drops of the fluid.

22. The printhead of claim 1, wherein the certain ones of the nozzles are all of the plurality of nozzles.

23. The printhead of claim 1, wherein the planar surface of the nozzle member is further positionable substantially parallel to and spaced apart from a plane of the medium.

24. The printhead of claim 1, wherein the nozzle axis of each of the certain ones of the nozzles has substantially the same degree of tilt.

* * * * *